US008360281B2

(12) United States Patent
DeJonge

(10) Patent No.: US 8,360,281 B2
(45) Date of Patent: Jan. 29, 2013

(54) CHILD RESISTANT CONTAINER WITH INVERTING CAP TOP KEY FOR SPRAY ACTIVATION

(76) Inventor: Stuart W. DeJonge, Deland, FL (US)

( * ) Notice: Subject to any disclaimer, the term of this patent is extended or adjusted under 35 U.S.C. 154(b) by 235 days.

(21) Appl. No.: 12/931,143

(22) Filed: Jan. 25, 2011

(65) Prior Publication Data

US 2012/0187151 A1 Jul. 26, 2012

(51) Int. Cl.
*B67D 7/06* (2010.01)

(52) U.S. Cl. ..... 222/182; 222/153.1

(58) Field of Classification Search ..... 222/182, 222/153.01, 153.1–153.14, 402.11–402.13; 215/218–221

See application file for complete search history.

(56) References Cited

U.S. PATENT DOCUMENTS 3,828,982 A * 8/1974 Steigerwald ..... 222/153.11
3,831,804 A 8/1974 Focht
4,171,758 A * 10/1979 Corba ..... 222/402.11
4,325,497 A * 4/1982 Ewald ..... 222/153.11
4,333,589 A 6/1982 Bush
4,555,035 A 11/1985 Davis
4,854,459 A 8/1989 DeJonge
5,509,550 A 4/1996 DeJonge
5,732,836 A 3/1998 Barker
6,029,835 A 2/2000 DeJonge
6,032,811 A 3/2000 Marconi
6,880,729 B2 4/2005 Stull
6,983,864 B1 * 1/2006 Cagle ..... 222/131
7,588,171 B2 * 9/2009 Reedy et al. ..... 222/153.11

* cited by examiner

*Primary Examiner* — Lien Ngo
(74) *Attorney, Agent, or Firm* — Kenneth P. Glynn, Esq.; Deirdra M. Meagher, Esq.

(57) ABSTRACT

A child resistant container with inverting cap top key for spray activation includes (a) a container main body adapted to receive a sprayer container with a top-positioned spray activator and spray nozzle; (b) an inner cap adapted for permanent connection to the open top of the container main body and having at least one key slot to permit at least one key to be inserted therein to permit a spray activator of a spray container to be activated by depression; (c) cut-out(s) to expose the spray activator nozzle when needed; (d) an outer cap to fit over the inner cap and having upwardly projecting key(s) for spray activation when the outer cap is inverted and inserted into the inner cap.

20 Claims, 11 Drawing Sheets

CHILD RESISTANT CONTAINER WITH INVERTING CAP TOP KEY FOR SPRAY ACTIVATION

BACKGROUND OF INVENTION a. Field of Invention

The field of the invention is child resistant containers with safety caps developed to inhibit dispensing of potentially harmful or restricted contents by children. The invention relates generally to a child resistant container that is adapted to receive and to lock in a sprayer container with a top-positioned spay activator. The device has a container body, an inner cap and an outer cap. The outer cap may be removed and inverted and then used to push down through the inner cap onto a spray container for user spray activation. The device is particularly beneficial as a retrofit child resistant container for potentially dangerous spray products to children; e. g., medicines, oven cleaners, etc.

b. Description of Related Art

The following patents are representative of the field pertaining to the present invention:

U.S. Pat. No. 6,880,729 B2 to Gene Stull et al describes a secure lock for container packaging with a flexible retaining lip of various formations for sealing against material product flow distributions with the secure seal preventing tampering of, for example, a flexible walled container of material such as a medication, food stuff or art material. A resistant secure lock is provided which in one embodiment meets Federal Child Safety Standards providing a seal of flexible locking and unlocking which is resistant to a child's tampering. In one embodiment, a tamper resistant seal is formed for a squeezable container cap with a flexible hinging structure connecting a cap to a cap receptor base structure of a container to prevent a material product such as medicine from dispensing without disengaging the seal selectively to allow access to an aperture, yet with a directed flexion of a lip or head, the seal simply unsnaps from a tamper resistant state to release the flow of product through an aperture from a container.

U.S. Pat. No. 6,032,811 to Anthony Marconi describes a child resistant cap assembly that includes an outer cap member having a top wall and a substantially cylindrical side wall depending therefrom. On the exterior surface of the top wall is a key slot and an alignment aperture. An inner cap member for threadedly engaging a container neck is concentrically received within said outer cap member has a mark and key slot on its top wall. The outer cap member normally rotates independently of the inner cap member. When the outer cap member's alignment aperture registers with the mark on the inner cap member, the key slots are aligned allowing a key member to be inserted therethrough. Accordingly, the inserted key member is then rotated to simultaneously rotate the inner and outer cap. The top wall of the outer cap member also includes means for removably retaining the key thereon.

U.S. Pat. No. 6,029,835 to Stuart DeJonge describes a child resistant safety cap for containers that includes an outer cap, an inner cap, at least one retractable-extendable key arm and a biasing spring. The outer cap has a top and a sidewall with a plurality of openings for retraction and extension of the key arms therethrough, and the top has an engaging mechanism for engaging and disengaging the key arms. The inner cap is contained within the outer cap, has a sidewall and a top, with a slide mechanism for slideably attaching a plurality key of arms. The inner cap is a predetermined height less than the inside vertically slidable within the outer cap. The inner cap has a first vertical position away from the top of the outer cap wherein said engaging mechanism of the outer cap and the connecting mechanism of the plurality of key arms are disengaged, and the inner cap has a second vertical position, toward the top of the outer cap wherein the engaging mechanism and the connecting mechanism are engaged. The inner cap also has threading on its inside for screwing onto and off a thread container.

U.S. Pat. No. 5,732,836 to Allan Barker et al. describes a closure for a container, including means for counting and indicating the number of times the closure has undergone a cycle of closing and opening the container, and further including means for incorporating the closure into means for resisting the opening of the container by a child. In a preferred embodiment, the closure includes an outer cover having an indicator symbol window an indicator symbol carrier rotatably mounted in the outer cover with indicator symbols visible through the indicator window, tooth and pawl means for allowing one-way rotation of the outer cover relative to the indicator symbol carrier to allow the advancement of the window and an audible click as the pawl passes over a tooth to confirm proper advancement, lost motion means for positively assuring the advancement of the window by one and only one indicator symbol upon each cycle, and a closure mechanism requiring the application of an axial force urging the closure toward the container while applying a rotational force to disengage the closure from the container.

U.S. Pat. No. 5,509,550 to Stuart DeJonge describes the child resistant cap device for containers with a threaded neck openings. It includes an inner cap, an outer cap and a key bar. The inner cap has a top and a sidewall having threads on its inside. The sidewall has on its outside, one of a male attaching mechanism and a female attaching mechanism for receiving and attaching the outer cap onto the inner cap so as to be rotatably fixed thereon. The top of the inner cap has a release key engagement on its outside, and the outside of the inner cap also has one way ratchets or ratchet blocks to permit engagement of the outer cap for rotating thereon, in a single, closing direction and preventing engagement of them for rotating them in a single, opposite, opening direction. The outer cap has a top and a sidewall having on its inside the other of a male attaching mechanism and a female attaching mechanism. The top of the outer cap has a release key bar with a key which is pivotable for 180° rotation so as to be engageable with the key arrangement of the inner cap so as to permit opening of the inner cap by rotation of the outer cap when the release key is engaged in the release key engagement.

U.S. Pat. No. 4,854,459 to Antonia DeJonge describes the present invention involves a container and cap which is generally childproof and may be rendered non-childproof permanently. The invention involves a container having a cylindrical neck at the top and threads molded about the exterior of the neck as well as an inner cap and outer cap. The inner cap has a top and a cylindrical side wall with threads molded on the inside of the side wall so as to mate with the threads of the container. The top or side of the inner cap has ratchet type segments on its outside and the outer cap has ratchet type segments on the inside of its top or side. The outer cap has a cylindrical side wall and is usually freely rotatable about the inner cap so as to be childproof. When in the childproof configuration as described, downward pressure is required by the user so as to engage the two ratchet type segments and thereby engage the two caps to permit opening. Further, the outer cap has an opening in its side wall at a lever near the bottom of the side wall of the inner cap and also has integrally attached thereto a flexible connector and stop. The flexible connector and stop are located so as to permit insertion of the stop into the opening so as to extend beyond the opening and push up the inner cap so as to permanently lock it into a position wherein the inner cap and outer cap ratchet type segments are permanently engaged. This renders the cap permanently non-childproof.

U.S. Pat. No. 4,555,035 to Eugene Davis describes a closure for a container. The closure is provided with a tunnel member into which any appropriate implement such as the handle of a teaspoon can be inserted when it is desired to manipulate the closure e.g. for opening. The provision of the tunnel member is of great assistance to people lacking in manual dexterity.

U.S. Pat. No. 4,333,589 to Randall Bush describes a child-resistant overcap for a pressurized container, such as an aerosol can, having a valve with an axially protruding discharge nozzle which must be depressed to actuate the valve for discharging the contents of the container. The overcap includes a valve guard moveable between an outer position in which a portion of the guard overlies the nozzle for preventing actuation thereof and an inner position in which the nozzle can be depressed. The overcap includes a resilient portion of the guard which biases the guard toward outer position and which must be overcome in order to move the guard to inner position and which returns the guard to outer position when the guard is released.

U.S. Pat. No. 4,325,497 to Ronald Ewald describes a child resistant spray through cover assembly for aerosol and similar containers. The cover assembly is adapted to be applied to a container having a conventional actuator button with a discharge outlet in which the actuator button discharges when it is moved axially toward the container. The cover assembly includes a housing which is adapted to fit over the actuator button and to be securely attached to the container. An opening is formed in the housing to allow the passage of spray discharge through the discharge outlet of the actuator button. A moveable flap is mounted on the housing and extends over the actuator button. The flap is moveable upon the application of force thereto by a finger of a user between a first position in which it is located out of actuating engagement with the actuator button and a second position in which it is in actuating engagement with the actuator button. A locking mechanism is provided to retain the flap in its first position. A finger engaging mechanism is provided for releasing the locking mechanism to permit the flap to be moved to its second position. A mechanism is provided on the flap for depressing the actuator button when the flap is moved to its second position. A spring arrangement is provided to return the flap to its first position and the locking mechanism to locking engagement with the flap when the application of force to the flap is discontinued so that the child resistant features of the cover assembly are automatically restored after the use and without any active participation of the user.

U.S. Pat. No. 3,831,804 to John Richard Focht describes an aerosol safety cap for an aerosol container including inner and outer telescoping members. The outer member includes dependant resilient locking means which snap under the interior of the annular bead of the mounting cup of the aerosol container to affix the outer member to the container. When the inner member is telescoped into the outer member, it prevents the resilient locking means from being inwardly deflected thereby preventing removal of the cap assembly from the container. Withdrawal of the inner telescopic member permits deflection of the depending locking means to permit removal of the cap from the container. The inner membrane cannot be withdrawn without the aid of a prying instrument such as a coin. The cap can be doubly locked by rotating the inner member with respect to the outer member with an instrument such as a coin into a position in which it can be pried upwardly.

Notwithstanding the prior art, the present invention is neither taught nor rendered obvious thereby.

SUMMARY OF INVENTION

The present invention is a child resistant container with inverting cap top key for spray activation. It includes (a) a container main body having an open top, a sidewall, and a bottom, said container main body adapted to receive a sprayer container with a top-positioned spray activator, said spray container spray activator having a spray nozzle having a predetermined top, undepressed height, and a predetermined bottom, depressed height, both as measured from the bottom of said spray container, said container main body having a first locking member for receiving and locking an inner cap thereto; (b) an inner cap adapted for permanent connection to said open top of said container main body and having a second locking member to coincide and lock with said first locking member, said inner cap having a top and a sidewall, said top having at least one key slot to permit at least one key to be inserted therein to permit a spray activator of a spray container to be activated by depression; (c) at least one of said inner cap sidewall and said sidewall of said container main body having a cut-out adapted to expose said spray activator nozzle when it is positioned at its top, predetermined undepressed height and at its bottom predetermined depressed height, and any position therebetween; (d) an outer cap adapted to fit over said inner cap and onto at least one of said inner cap and said container main body, said outer cap having a top, a sidewall and at least one upwardly projecting key for spray activation; wherein a user may insert a sprayer container into said container main body, permanently attach said inner cap to said container main body, and cover said inner cap with said outer cap and onto at least one of said inner cap and said container main body for storage and safekeeping; and, wherein a user may subsequently remove said outer cap, invert it, place it on the top of said container main body and align the at least one key with said inner cap top at least one key slot, and push down upon said outer cap to cause said at least one key to push said spray activator down to spray contents of said spray container.

In some embodiments of the present invention child resistant container with inverting cap top key for spray activation, the container main body, said inner cap and said outer cap have circular top view footprints.

In some embodiments of the present invention child resistant container with inverting cap top key for spray activation, the first locking member and said second locking member are coinciding components of a force-fit locking protrusion and recess.

In some embodiments of the present invention child resistant container with inverting cap top key for spray activation, the outer cap of extends downwardly over said container main body and is friction fitting to the container main body.

In some embodiments of the present invention child resistant container with inverting cap top key for spray activation, the outer cap top is recessed and said at least one upwardly projecting key is located on said recessed top.

In some embodiments of the present invention child resistant container with inverting cap top key for spray activation, there are at least two upwardly projecting key on said outer cap and there are an equal number of corresponding key slots on said top of said inner cap.

In some preferred embodiments of the present invention child resistant container with inverting cap top key for spray activation, the device includes: (a) a container main body having an open top, a sidewall, and a bottom, said container main body adapted to receive a sprayer container with a top-positioned spray activator, said spray container spray activator having a spray nozzle having a predetermined top, undepressed height, and a predetermined bottom, depressed height, both as measured from the bottom of said spray container, said main container body having inside friction engagement means to inhibit rotation of said spray container when positioned therein, said container main body having a first locking member for receiving and locking an inner cap thereto; (b) an inner cap adapted for permanent connection to said open top of said container main body and having a second locking member to coincide and lock with said first locking member, said inner cap having a top and a sidewall, said top having at least one key slot to permit at least one key to be inserted therein to permit a spray activator of a spray container to be activated by depression; (c) at least one of said inner cap sidewall and said sidewall of said container main body having a cut-out adapted to expose said spray activator nozzle when it is positioned at its top, predetermined undepressed height and at its bottom predetermined depressed height, and any position therebetween; (d) an outer cap adapted to fit over and cover said inner cap and onto at least one of said inner cap and said container main body, said outer cap having a top, a sidewall and at least one upwardly projecting key for spray activation; wherein a user may insert a sprayer container into said container main body, permanently attach said inner cap to said container main body, and cover said inner cap with said outer cap and onto at least one of said inner cap and said container main body for storage and safekeeping; and, wherein a user may subsequently remove said outer cap, invert it, place it on the top of said container main body and align the at least one key with said inner cap top at least one key slot, and push down upon said outer cap to cause said at least one key to push said spray activator down to spray contents of said spray container. In this preferred embodiment, each of the additional features described in the preceding paragraphs may be included in conjunction therewith.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Figure 1:
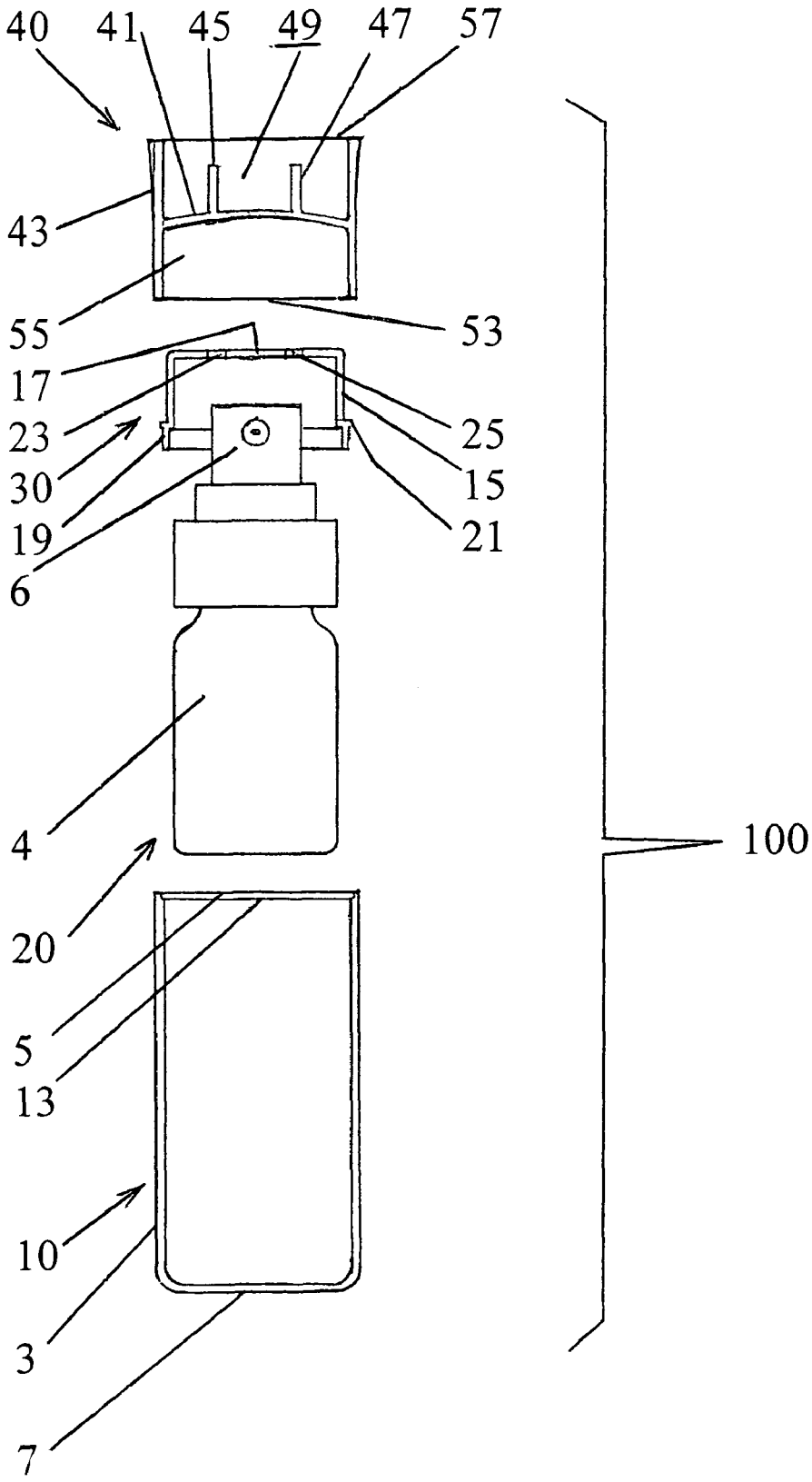
FIG. 1 shows an exploded cut front view of a present invention child resistant container with inverting cap top key features and also shows an uncut front view of a sprayer container with a top-mounted spray activator and nozzle.

The invention relates generally to a child resistant container that is adapted to receive and to lock in a sprayer container with a top-positioned spray activator. The device is particularly beneficial as a retrofit child resistant container for potentially dangerous spray products to children, e. g., medicines, oven cleaners, etc. The device has a container main body for receiving the sprayer container, an inner cap to lock in the spray container and to allow the spray activator to rise up and down to be exposed, i.e., to be able to be depressed and released for spraying and stopping. The inner cap thus has a top seat(s) to allow keys to pass through. An outer cap acts as an over cap and can be removed and inverted to expose the push key(s). Once invented, the now downwardly facing push key(s) are fitted into the key slots that geometrically correspond to and receive the key(s). Also, because the outer cap has a downwardly extending tongue that conceals a corresponding opening in the present invention container main body, when the outer cap is inverted and the push rods are properly inverted and otherwise concealed, this spray window is open. When the outer cap is thus inverted and inserted, it is merely pushed downwardly to activate the spray activator for spraying.

Referring now to the drawings wherein like reference numerals designate corresponding parts throughout the several views, the present invention is exemplified as follows:

FIG. 1 shows an exploded cut front view of a present invention child resistant container with inverting cap top key features and also shows an uncut front view of a sprayer container 20 with a top-mounted spray activator 60 and nozzle, contained therein. These are collectively shown as loaded present invention device 100. The present invention child resistant container includes a container main body 10, an inner cap 30 and an outer cap 40. The container main body 10 has an open top 5, a circular sidewall 3 and a bottom 7. Although sidewall 3 has a circular top view footprint, it could take any shape that would receive a spray container. Further, it need not have the same footprint shape as a spray container. For example, a circular spray container would readily fit into a hexagonal or octagonal container main body.

Figure 2:
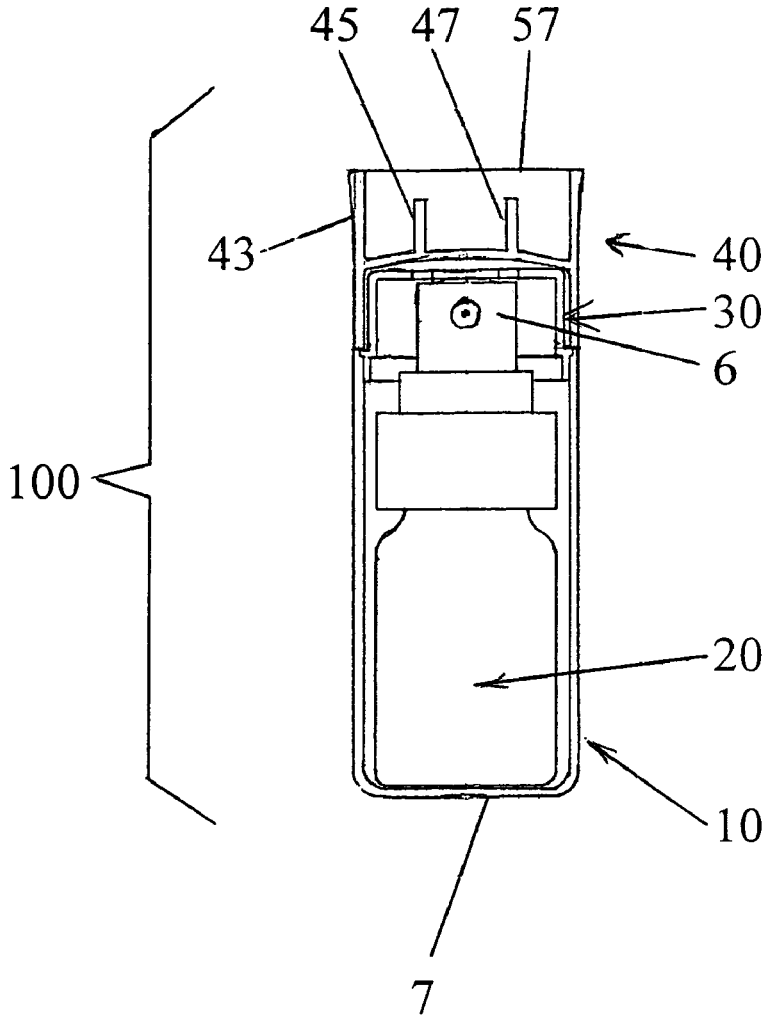
FIG. 2 illustrates a cut front view of the present invention and the spray container shown in FIG. 1 fully assembled.

Although FIG. 1 shows an exploded view, FIG. 2 illustrates a fully assembled view of the same elements. Thus, in FIG. 2, the loaded device is likewise collectively shown as present invention device 100. The following and foregoing discussion is in reference to both FIG. 1 and FIG. 2.

Spray container 20 has sidewall 4 and a top-positioned spray activator 6 with a nozzle. Preferably, container main body 10 is designed to receive spray container 20 with slight friction to prevent rotation of the spray container 20. On the inside of sidewall 3 of container main body 10, near the open top 5, is a first locking member 13 for receiving and locking inner cap 30 thereto. (This is shown as a receiving or female track, i.e. indented, and its counterpart on the inner cap is male or raised. However these could be reversed wherein the first locking member, on the container main body, would be a male, and its counterpart, the second locking member, on the inner cap, would be female.)

Spray container 20 is inserted into container main body 10 and then inner cap 30 is permanently attached to open top 5. Inner cap 30 includes a spray nozzle window (shown below in FIG. 6 as window 32), which must be aligned with the nozzle of spray activator 6. This may be accomplished visually but is preferably achieved with track stops or different guide means such a one or more vertical corresponding male and female tracks.

Inner cap 30 has a sidewall 15 and a top 17 with spray activator key slots 23 and 25. Inner cap 30 also has a ledge 21 and a second locking member 19. When inner cap 30 is pushed into container main body 10, the male locking track, also known as second locking member 19, snaps into female receiving first locking member 13 of container main body 10, with ledge 21 fitting atop sidewall 3. Key slots 23 and 25 are of similar footprint to outer cap 40's keys 45 and 47 and are large enough to permit keys 23 and 25 to pose therethrough Outer cap 40 has a central top 41, a sidewall 43 and a lower portion sidewall 55, as shown. Outer cap 40 has an open bottom 53. The inside lower of sidewall 55 of outer cap 40 is, in this embodiment, adapted to fit over inner cap 30 and to snuggly fit inner cap 20, but could be extended and adopted to fit onto container main body 10. Extending upwardly from the inside of top 41 of outer cap 40 are two push keys 45 and 47. These have the same footprint and are positioned to fit into push key slots 23 and 25 of inner cap 30 when outer cap 40 is inverted and positioned atop inner cap 30. Also, push keys 23 and 25 are of sufficient length such that when they are inserted and pushed into push key slots 23 and 25, they press down on spray container spray activator 6 to spray the contents of spray container 20. As mentioned above, FIG. 1 is an exploded partially cut view and FIG. 2 shows the same partially cut elements fully assembled.

Figure 3:
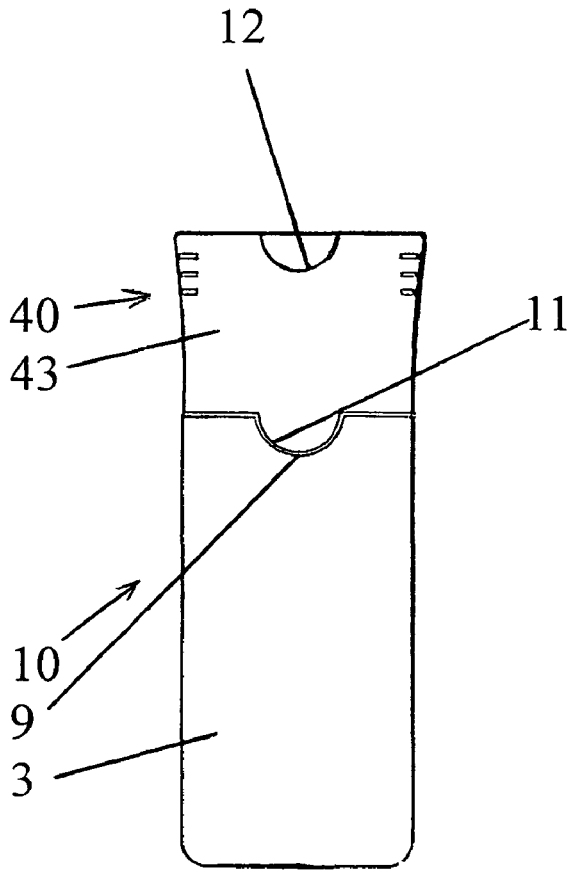
FIG. 3 shows a front view of the preferred present invention device illustrated in the preceding figures.
Figure 4:
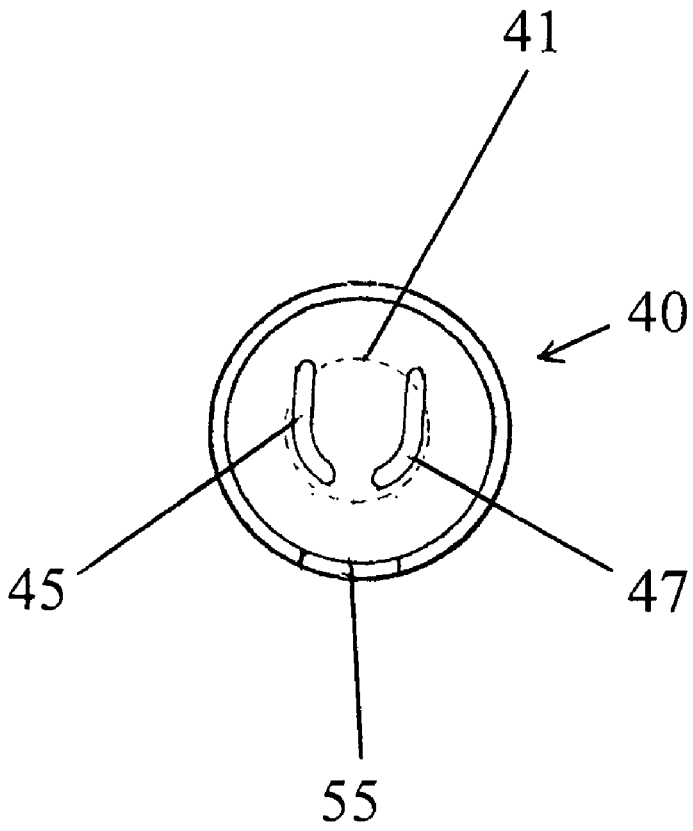
FIG. 4 shows a top view of the present invention outer cap shown in the preceding drawings.

FIG. 3 shows a front view and FIG. 4 shows a top view of the preferred present invention device illustrated in the preceding figures. Identical parts in these figures are identically numbered as presented in the previous drawings. These are also true of the subsequent Figures below and, hence, are not necessarily repeated further herein. As can be seen in FIG. 3, container main body sidewall 3 has a downward cut out 9 that is complementary to tongue 11 of sidewall 43 of outer cap 40. Likewise, outer cap 40 has a top edge recess 12. When outer cap 40 is removed, cut out 9 is aligned with and reveals part of the spray activator nozzle of spray container 20. Also exposed is window 32 cut into inner cap 30, which is also aligned with the spray activator nozzle (see FIG. 6). Further, when outer cap 40 is inverted, it is placed on top of inner cap 30 so that recess 12 is aligned with cutout 9. This exposes the spray nozzle for subsequent effective use. (Although the spray nozzle window is established by recesses and cutouts in both the container main body 10 and outer cap 40, the same results could be achieved by raising or lowering the height of sidewall 3 and having only cutouts in one or the other of container main body 10 and outer cap of 40, without exceeding the scope of present invention.)

Figure 5:
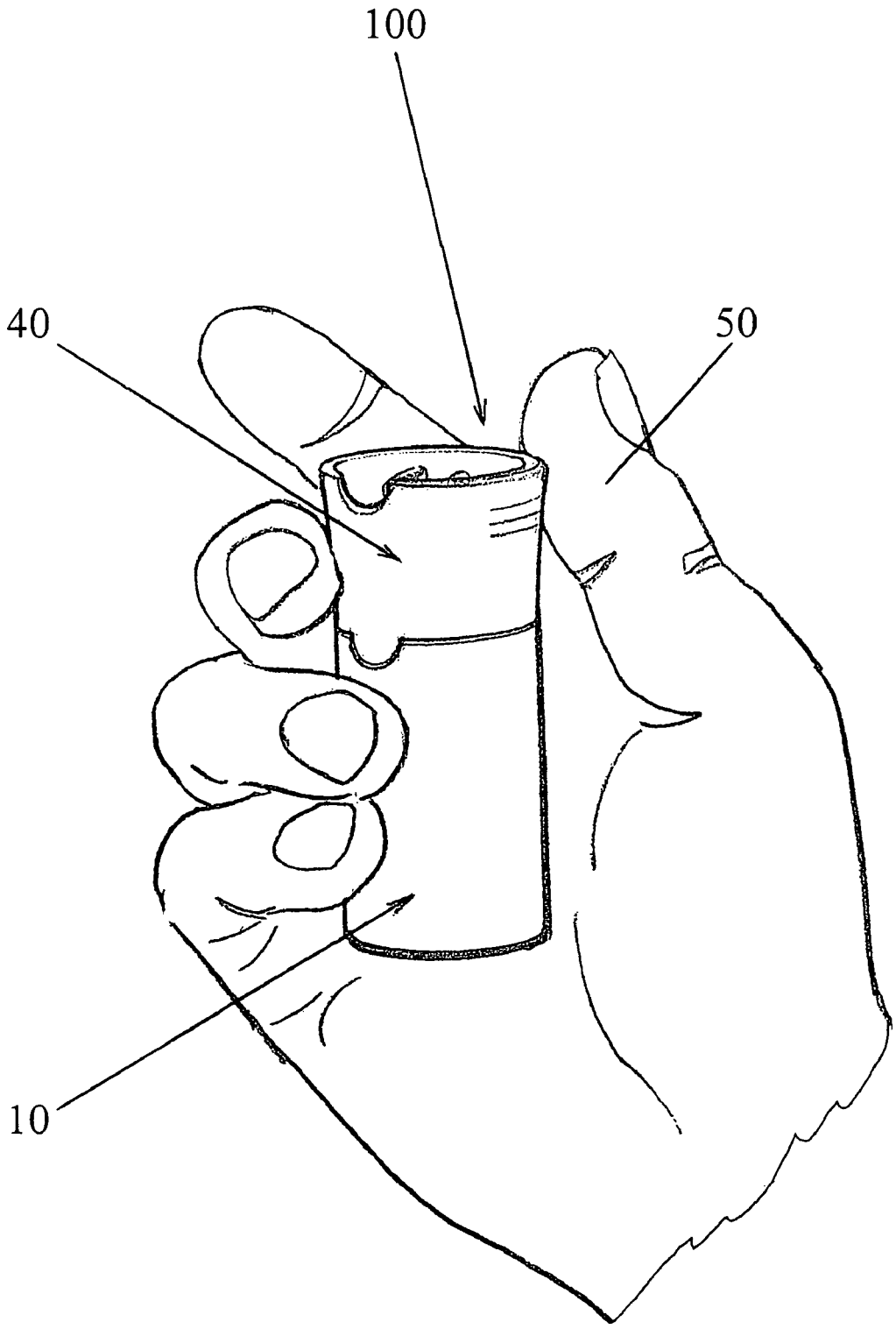
FIG. 5 shows a person's right hand holding a present invention device as illustrated above.

FIG. 5 shows a person's right hand 50 holding a present invention device 100 as illustrated above. As can be seen, the present invention device 100 is easily hand held, self-sufficient and extremely portable.

Figure 6:
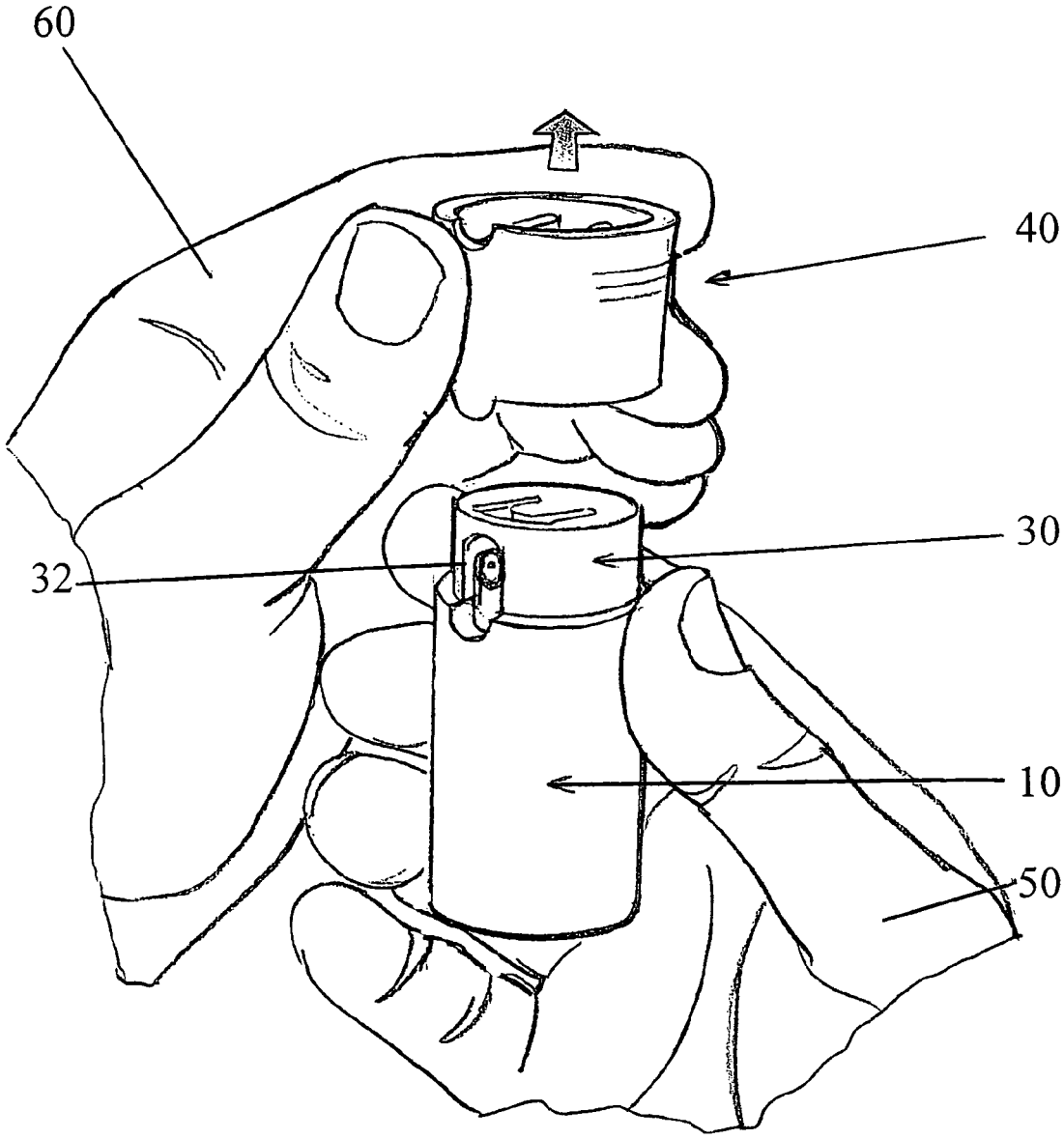
FIG. 6 shows a present invention device of FIG. 6 with two hands, one holding the present invention container main body and one removing the outer cap therefrom for inversion.

FIG. 6 shows a present invention device 100 of FIG. 5 with two hands 50 and 60, one holding the present invention container main body 10 and one removing the outer cap 40 therefrom, so as to reveal the spray nozzle through inner cap window 32.

Figure 7:
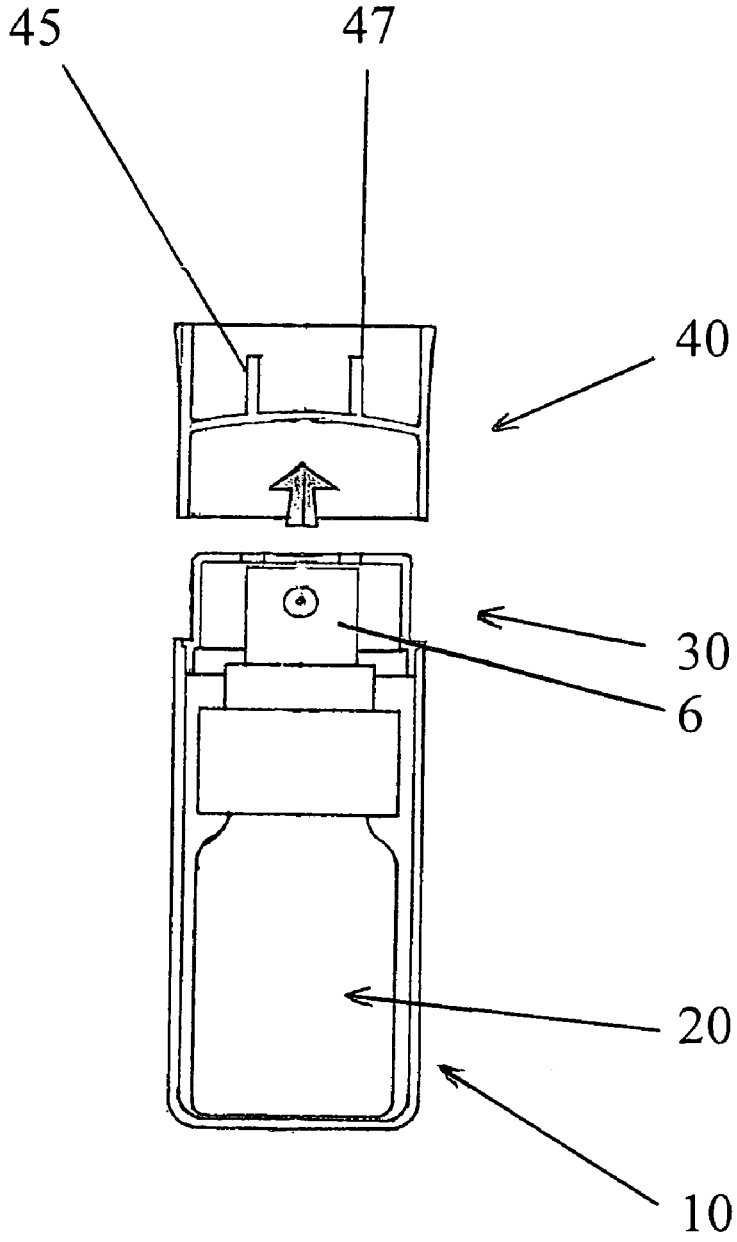
FIG. 7 shows a cut view of the present invention devices it appears in FIG. 6.

FIG. 7 shows a cut view of the present invention device 100 it appears in FIG. 6.

Figure 8:
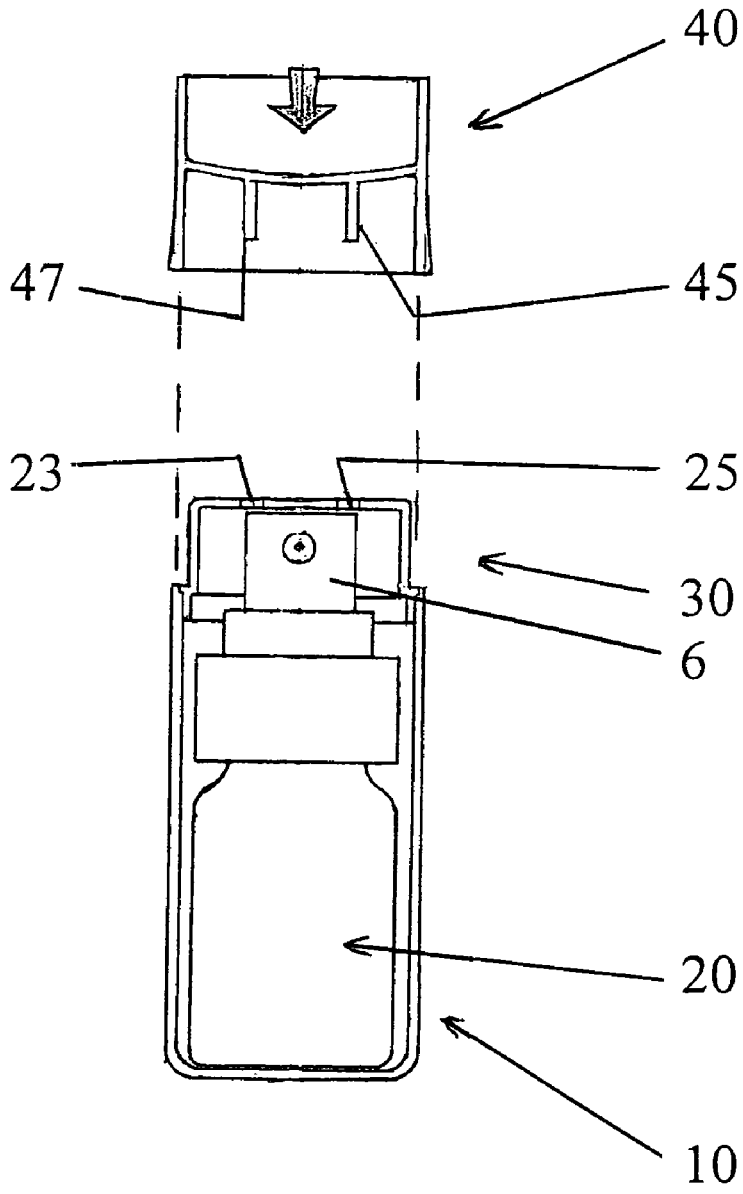
FIG. 8 shows the present invention device of FIGS. 6 and 7 but with the removed outer cap now inverted and moving toward the top of the container main body for subsequent pushing of the spray container spray activator.

FIG. 8 shows the present invention device 100 of FIGS. 6 and 7 but with the removed outer cap 40 now inverted and moving toward the top of inner container 30 with keys 45 and 47 aligned with and moving toward slots 25 and 23, respectively.

Figure 9:
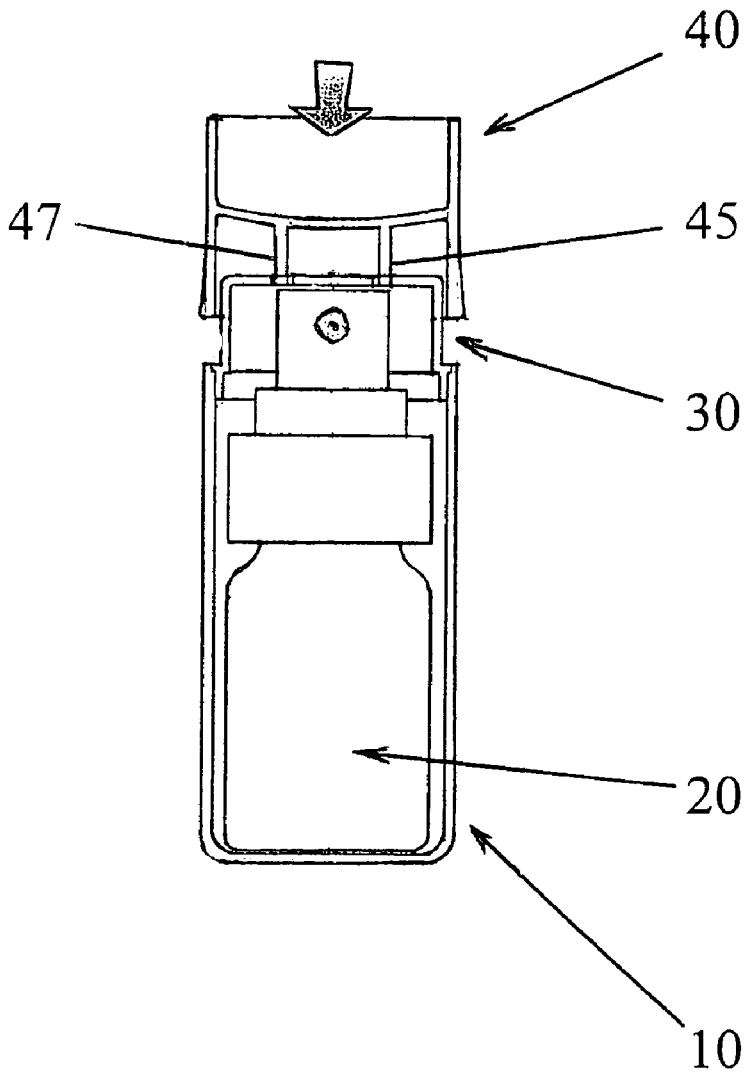
FIG. 9 shows a cut view of the present invention device as it appears in FIG. 8, except that the push rod keys of the outer cap have been inserted into the inner cap.
Figure 10:
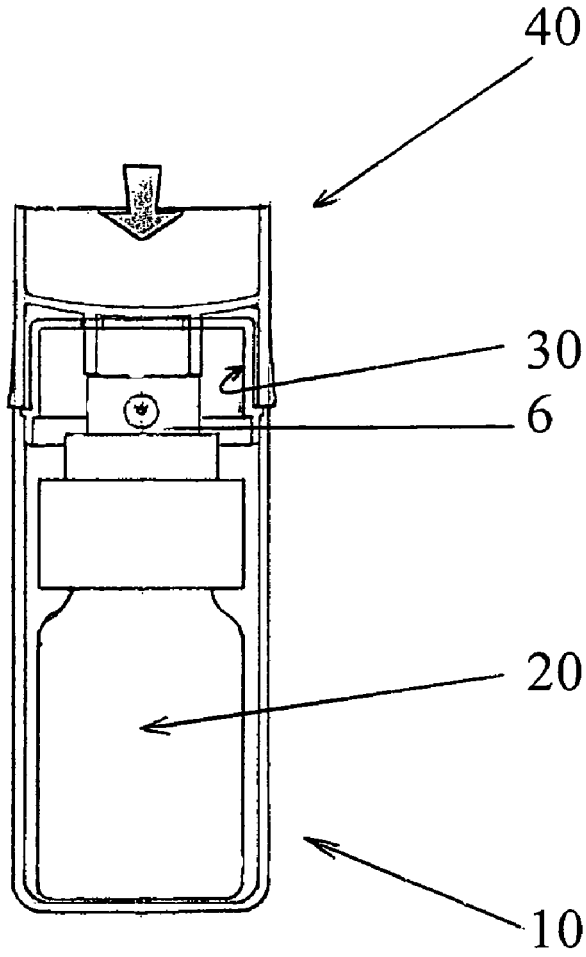
FIG. 10 shows a cut view of the present invention device illustrated above, but fully pushed down so as to activate the spray activator for spraying; and, FIG. 11 shows a person's hand using the present invention device as shown in FIG. 10, but with the spray activator being depressed and spraying.
Figure 11:
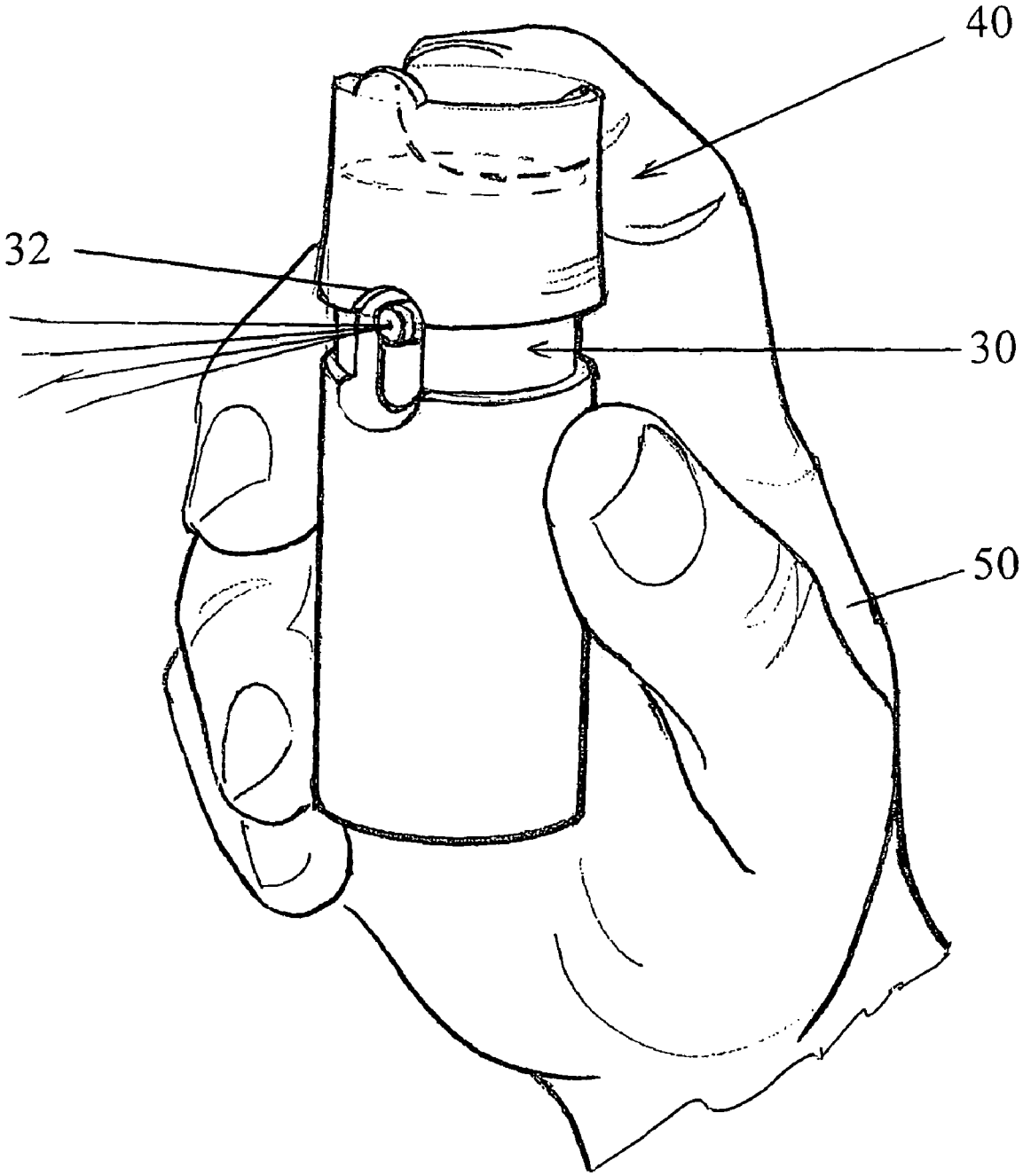

FIG. 9 shows the same present invention device 100, but with inverted outer cap 40 nesting on inner cap 30 with keys 45 and 47 touching spray activator 6; FIG. 10 shows the same present device but with inner cap 40 fully depressed, pressing spray activator 6 down to release a spray. This is more fully illustrated in FIG. 11 showing actual use.

Once a user has completed a spray application from the spray container, the user removes the outer cap 40 from the top of the inner cap 30 and the container main body 10, inverts it, and then recaps the device to the original, closed, child resistant state, as shown in FIG. 2. This is easily visualized in that the steps shown sequentially in FIGS. 6, 7, 8 and 9 are reversed.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A child resistant container with inverting cap top key for spray activation, which comprises:

(a) a container main body having an open top, a sidewall, and a bottom, said container main body adapted to receive a sprayer container with a top-positioned spray activator, said spray container spray activator having a spray nozzle having a predetermined top, undepressed height, and a predetermined bottom, depressed height, both as measured from the bottom of said spray container, said container main body having a first locking member for receiving and locking an inner cap thereto;

(b) an inner cap adapted for permanent connection to said open top of said container main body and having a second locking member to coincide and lock with said first locking member, said inner cap having a top and a sidewall, said top having at least one key slot to permit at least one key to be inserted therein to permit a spray activator of a spray container to be activated by depression;

(c) at least one of said inner cap sidewall and said sidewall of said container main body having a cut-out adapted to expose said spray activator nozzle when it is positioned at its top, predetermined undepressed height and at its bottom predetermined depressed height, and any position therebetween;

(d) an outer cap adapted to fit over said inner cap and onto at least one of said inner cap and said container main body, said outer cap having a top, a sidewall and at least one upwardly projecting key for spray activation;

wherein a user may insert a sprayer container into said container main body, permanently attach said inner cap to said container main body, and cover said inner cap with said outer cap and onto at least one of said inner cap and said container main body for storage and safekeeping; and, wherein a user may subsequently remove said outer cap, invert it, place it on the top of said container main body and align the at least one key with said inner cap top at least one key slot, and push down upon said outer cap to cause said at least one key to push said spray activator down to spray contents of said spray container.

2. The child resistant container with inverting cap top key for spray activation of claim 1 wherein said container main body, said inner cap and said outer cap have circular top view footprints.

3. The child resistant container with inverting cap top key for spray activation of claim 1 wherein said first locking member and said second locking member are coinciding components of a force-fit locking protrusion and recess.

4. The child resistant container with inverting cap top key for spray activation of claim 1 wherein said outer cap extends downwardly over said container main body and is friction fitting to said container main body.

5. The child resistant container with inverting cap top key for spray activation of claim 1 wherein said outer cap top is recessed and said at least one upwardly projecting key is located on said recessed top.

6. The child resistant container with inverting cap top key for spray activation in claim 1 wherein there are at least two upwardly projecting key on said outer cap and there are an equal number of corresponding key slots on said top of said inner cap.

7. The child resistant container with inverting cap top key for spray activation of claim 6 wherein said container main body, said inner cap and said outer cap have circular top view footprints.

8. The child resistant container with inverting cap top key for spray activation of claim 6 wherein said first locking member and said second locking member are coinciding components of a force-fit locking protrusion and recess.

9. The child resistant container with inverting cap top key for spray activation of claim 6 wherein said outer cap extends downwardly over said container main body and is friction fitting to said container main body.

10. The child resistant container with inverting cap top key for spray activation of claim 6 wherein said outer cap top is recessed and said at least one upwardly projecting key is located on said recessed top.

11. A child resistant container with inverting cap top key for spray activation which comprises:

(a) a container main body having an open top, a sidewall, and a bottom, said container main body adapted to receive a sprayer container with a top-positioned spray activator, said spray container spray activator having a spray nozzle having a predetermined top, undepressed height, and a predetermined bottom, depressed height, both as measured from the bottom of said spray container, said main container body having inside friction engagement means to inhibit rotation of said spray container when positioned therein, said container main body having a first locking member for receiving and locking an inner cap thereto;

(b) an inner cap adapted for permanent connection to said open top of said container main body and having a second locking member to coincide and lock with said first locking member, said inner cap having a top and a sidewall, said top having at least one key slot to permit at least one key to be inserted therein to permit a spray activator of a spray container to be activated by depression;

(c) at least one of said inner cap sidewall and said sidewall of said container main body having a cut-out adapted to expose said spray activator nozzle when it is positioned at its top, predetermined undepressed height and at its bottom predetermined depressed height, and any position therebetween;

(d) an outer cap adapted to fit over and cover said inner cap and onto at least one of said inner cap and said container main body, said outer cap having a top, a sidewall and at least one upwardly projecting key for spray activation;

wherein a user may insert a sprayer container into said container main body, permanently attach said inner cap to said container main body, and cover said inner cap with said outer cap and onto at least one of said inner cap and said container main body for storage and safekeeping; and, wherein a user may subsequently remove said outer cap, invert it, place it on the top of said container main body and align the at least one key with said inner cap top at least one key slot, and push down upon said outer cap to cause said at least one key to push said spray activator down to spray contents of said spray container.

12. The child resistant container with inverting cap top key for spray activation of claim 11 wherein said container main body, said inner cap and said outer cap have circular top view footprints.

13. The child resistant container with inverting cap top key for spray activation of claim 11 wherein said first locking member and said second locking member are coinciding components of a force-fit locking protrusion and recess.

14. The child resistant container with inverting cap top key for spray activation of claim 11 wherein said outer cap extends downwardly over said container main body and is friction fitting to said container main body and includes a downwardly extending tongue to cover said cut-out when it is covering said inner cap.

15. The child resistant container with inverting cap top key for spray activation of claim 11 wherein said outer cap top is recessed and said at least one upwardly projecting key is located on said recessed top.

16. The child resistant container with inverting cap top key for spray activation in claim 11 wherein there are at least two upwardly projecting key on said outer cap and there are an equal number of corresponding key slots on said top of said inner cap.

17. The child resistant container with inverting cap top key for spray activation of claim 16 wherein said container main body, said inner cap and said outer cap have circular top view footprints.

18. The child resistant container with inverting cap top key for spray activation of claim 16 wherein said first locking member and said second locking member are coinciding components of a force-fit locking protrusion and recess.

19. The child resistant container with inverting cap top key for spray activation of claim 16 wherein said outer cap extends downwardly over said container main body and is friction fitting to said container main body and includes a downwardly extending tongue to cover said cut-out when it is covering said inner cap.

20. The child resistant container with inverting cap top key for spray activation of claim 16 wherein said outer cap top is recessed and said at least one upwardly projecting key is located on said recessed top.

* * * * *